United States Patent [19]

Rossini

[11] 4,073,256

[45] Feb. 14, 1978

[54] LIGHTWEIGHT ANCHOR HAVING HIGH STRENGTH TO WEIGHT RATIO

[76] Inventor: Alfred P. Rossini, 6 Belmore Road, Framingham, Mass. 01701

[21] Appl. No.: 746,100

[22] Filed: Dec. 1, 1976

[51] Int. Cl.[2] ..... B63B 21/44

[52] U.S. Cl. ..... 114/306; 114/304

[58] Field of Search ..... 114/294–310; 228/173 C; 52/729, 730, 294

[56] References Cited

U.S. PATENT DOCUMENTS

| | | | |
|---|---|---|---|
| 2,997,141 | 8/1961 | Wetzler | 52/730 |
| 3,015,299 | 1/1962 | Towne | 114/310 |
| 3,332,387 | 7/1967 | Winslow | 114/303 |
| 3,365,696 | 12/1944 | Grubb | 228/173 C |
| 3,783,815 | 1/1974 | Towne | 114/302 |
| 3,822,666 | 7/1974 | Blomberg | 114/303 |

FOREIGN PATENT DOCUMENTS

| | | | |
|---|---|---|---|
| 222,857 | 12/1923 | Germany | 294/49 |

*Primary Examiner*—Trygve M. Blix
*Assistant Examiner*—D. W. Keen
*Attorney, Agent, or Firm*—Irving M. Kriegsman

[57] ABSTRACT

A lightweight anchor in which each one of the flukes is made up of two sheets of stainless steel plate stock, stacked one on top of the other and welded together. Each sheet contains a plurality of integrally formed, longitudinally extending ribs and the inner and outer edges of each sheet are bent to form upwardly extending perpendicular flanges. The crown is a generally U-shaped member made out of stainless steel plate stock. The angle of rotation of the shank relative to the flukes is limited by a pin connected to the shank and extending into angular slots in support plates attached to the flukes. A pair of stainless steel U-shaped braces made out of bar stock are rigidly connected to the flukes to prevent yawning movement of the flukes and also serve as a back up mechanism for limiting the angular movement of the shank relative to the flukes. All the surfaces on the anchor are electropolished.

11 Claims, 5 Drawing Figures

LIGHTWEIGHT ANCHOR HAVING HIGH STRENGTH TO WEIGHT RATIO

BACKGROUND OF THE INVENTION

This invention relates to anchors. More particularly, this invention relates to lightweight anchors.

A lightweight anchor is a type of anchor made up essentially of a shank, a stock, a crown and a pair of flukes. The principal feature of a lightweight anchor is its high holding power to weight ratio. The holding power of a lightweight anchor is dependent on several factors including the weight of the anchor, the shape of the flukes, the surface area (size) of the flukes, and the strength of the flukes. The strength of the flukes, that is, the resistance of the flukes to bending or failure is dependent on the type of material used in making the flukes, the thickness and design of the flukes and the manner in which the flukes are fabricated.

In the past, the flukes in a lightweight anchor have been made of a single sheet of mild steel suitably cut and shaped, or out of a casting of high strength steel or out of aluminum by extrusion. Flukes have also been made of a single sheet of stainless steel, suitably cut and shaped, but, because of the high cost of stainless steel as compared to most other steels or aluminum, stainless steel flukes have not enjoyed much commercial success. In any event, in all cases the fluke bodies have been of a unitary construction.

In U.S. Pat. No. 3,783,815 to R. C. Town et al. there is illustrated a lightweight cast steel anchor in which the flukes contain integrally formed, molded stiffening ribs to increase the strength and holding power of the anchor. Some other examples of lightweight anchors can be found in U.S. Pat. No. 3,780,688 to D. C. Hungerforth and U.S. Pat. No. 3,782,318 to D. C. Hungerforth.

SUMMARY OF THE INVENTION

It is an object of this invention to provide a new and improved lightweight anchor.

It is another object of this invention to provide a lightweight anchor having a high holding power to weight ratio.

It is still another object of this invention to provide a new and improved fluke construction for a lightweight anchor.

It is yet still another object of this invention to provide a new and improved technique for fabricating the flukes in a lightweight anchor.

It is another object of this invention to provide a new and improved arrangement for controlling the maximum angle of rotation between the flukes and the shank in a lightweight anchor.

It is still another object of this invention to provide a lightweight anchor in which the flukes will dig into and pull out of the sand or mud more easily than conventional lightweight anchors.

It is yet still another object of this invention to provide an arrangement for reducing the weight without reducing the holding power in a lightweight anchor.

It is still another object of this invention to provide a lightweight anchor having an improved crown construction.

A lightweight anchor constructed according to this invention includes a shank, a stock, a crown and a pair of flukes. Each one of the flukes is made up of two sheets of plate stock material stacked one on top of the other and laminated together. Each sheet includes a plurality of longitudinally extending, integrally formed, raised ribs and is bent on its inner and outer edges to form upwardly extending perpendicular flanges. The crown is made of a single sheet of plate stock material. The stock is made of bar material and the shank is made of tubing. The shank includes a pin which extends into an angular slot formed in each one of a pair of support plates attached to the flukes (and crown) for limiting the angular movement of the shank relative to the flukes. The anchor further includes a pair of U-shaped braces which prevent the flukes from pulling apart from each other, and also serve as a backup system for limiting the angular movement of the shank relative to the flukes. All the component parts of the anchor are made of stainless steel and the surfaces of all the parts, especially the flukes are electropolished.

One of the principal features of the invention is the idea of making the flukes out of two sheets of plate stock, stacked one on top of the other, laminated together, with each sheet being bent on its inner and outer edges to form flanges and with each sheet containing a plurality of integrally formed, longitudinally extending, raised ribs. By making the flukes in this manner, the overall strength of the flukes and consequently, the strength-to-weight ratio of the flukes, is significantly increased. Also, since anchor parts are made of stainless steel, corrosion is reduced to a minimum. Also, since the surfaces of the flukes are electropolished they are smoother and less porous than flukes made of other materials and hence will dig into sand and/or mud and pull out of sand and/or mud more easily than other types of flukes.

The invention is not limited to any particular size anchor. It is believed that flukes constructed according to this invention with two sheets, ribbed, formed and laminated as described above in which the thickness of the material used in each sheet is, for example, 0.060 inch is comparable in strength to flukes made using a single sheet of material having a thickness of 0.20 inch, all other parameters, type material, fluke shape, etc. being the same. In other words, the thickness of each one of the two sheets can be approximately 40% less than one half the thickness of a single sheet version and there will not be any reduction in strength. This translates into a 40% reduction in weight of the anchor, or expressed differently a 40% reduction in the amount of material needed for the flukes. This, in turn, results in a 40% reduction in material cost.

At the same time, because the flukes are thinner they will have a higher burial capability and consequently a higher holding power.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which like reference numerals or characters represent like parts and wherein.

DESCRIPTION OF THE PREFERRED EMBODIMENT

Figure 1:
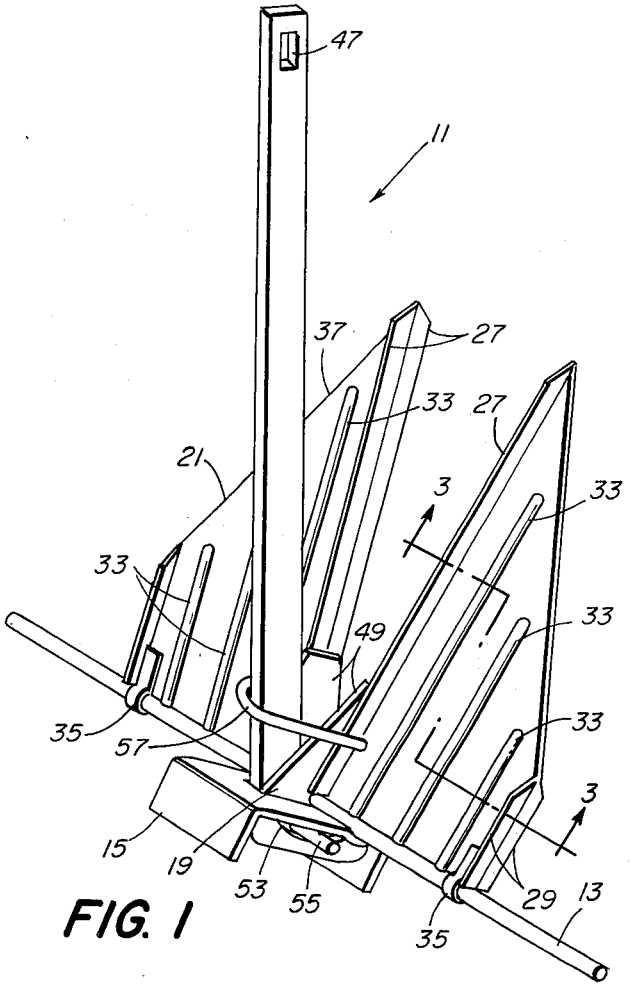
FIG. 1 is a perspective view of an anchor constructed according to this invention.
Figure 2:
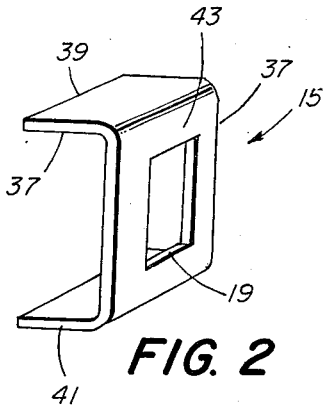
FIG. 2 is a perspective view of the crown of the anchor shown in FIG. 1.
Figure 4:
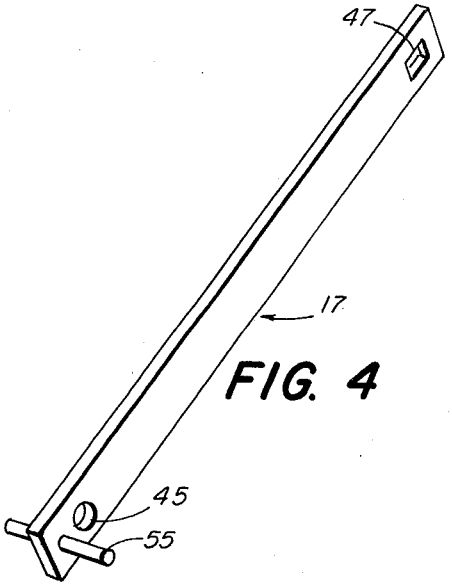
FIG. 4 is a perspective view of the shank of the anchor shown in FIG. 1.
Figure 3:
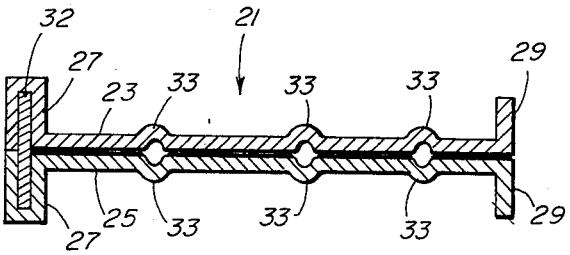
FIG. 3 is a section view of one of the flukes of the anchor taken along line 3—3 in FIG. 1.
Figure 5:
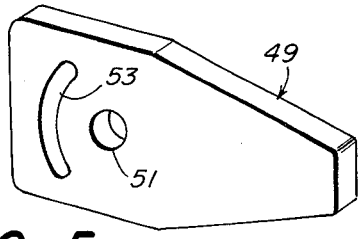
FIG. 5 is a perspective view of one of the support plates of the anchor shown in FIG. 1.

Referring now to the drawings, there is shown a lightweight anchor constructed according to this invention and identified generally by reference numeral 11.

The anchor 11 includes a stock 13, a crown 15 rigidly secured to the stock 13, a shank 17 pivotally mounted on the stock 13 near one end and extending through a slot 19 in the crown 15, and a pair of trapezoidal shaped flukes 21 symmetrically disposed on either side of the shank in front of the crown 15 and rigidly secured to the stock 13.

Each fluke 21 is made up of two sheets 23 and 25 of stainless steel spot welded together. The inner edge 27 of each sheet is bent up and down again to form a channel shaped perpendicular flange and the outer edge 29 of each sheet is bent up to form a perpendicular flange. Both flanges are formed for strengthening purposes. A strip of stainless steel 32 is disposed in the slot formed by each pair of facing channels to further strengthen the inner edges of the flukes 21. Formed on each sheet 23 and 25, also for strengthening purposes, are a plurality of parallel, spaced apart longitudinally extending raised, ribs 33. The ribs 33 are formed on the individual sheets 23, 25 before they are laminated using a punch press or similar machine shop equipment. As can be seen, when the two sheets are joined together, all the ribs on each sheet are raised rather than recessed. The outer face of each sheet 23, 25 is electropolished to provide a very smooth surface and also to provide a shiny surface. The back edges of flukes 21 are welded to the stock 13 in the area between adjacent ribs. Flukes 21 are further secured to the stock 13 by 'C' clamps 35 which are welded to the flukes 21 and the stock 13.

Stock 13 is made of stainless steel bar stock and is electropolished on its entire surface.

Crown 15 is a generally U-shaped member of stainless steel material and is electropolished over its entire surface. Crown 15 is made by taking a sheet of stainless steel of generally rectangular configuration and bending the top 39 and bottom 41 to form the U-shape. Sides 37 may be bent (not shown) to form perpendicular flanges for strengthening purposes. The base 43 of the crown 15 is welded to the stock 13 with the legs of the U directed away from the flukes 21. Slot 19 may be formed in the crown 15 by stamping.

Shank 17 is a tubular member of stainless steel construction, generally rectangular in cross-section, electropolished over its entire outer surface and provided with an aperture 45 near one end so that it can be pivotally mounted on the stock 13. Shank 17 also includes an aperture 47 near the other end so that it can be attached to an anchor chain (not shown).

Anchor 11 further includes a pair of support plates 49 which are rigidly mounted on the stock 13 through apertures 51 and extend through the slot 19 in the crown 15. Plates 49 are welded to the stock 13, to the crown 15 and also to the inner edges 27 of the flukes 21. Each plate 49 includes an angular slot 53 which receives a pin 55 that is rigidly attached to the shank 17. Thus, the angular size of slot 53 determines the maximum angular movement of the shank 17 relative to the flukes 21. Support plates 49 are made of stainless steel and are electropolished.

Finally, the anchor 11 includes a pair of U-shaped braces 57 made of stainless steel bar stock material. One of the braces 57 is welded to the outer walls of plates 49 and to the top of sheet 23 of each fluke 21 and the other brace (not shown) is welded to the outer walls of plates 49 and the top of sheet 25 of each fluke 21. Braces 57 perform two functions. Firstly, braces 57 prevent any possible yawning movement of the flukes 21 (i.e., pulling away of the flukes from each other). Secondly, the height of each brace 57 and the distance of each brace from the stock 13 is such that the maximum angle through which shank 17 can travel relative to the flukes before hitting the braces 57 is slightly more than the angle defined by slot 53. In this way, braces 57 serve as a backup system of stops limiting the angular movement of the shank 17 relative to the flukes 21. For example, slot 53 may be sized to produce a maximum angular movement of the shank 17 of 64° (i.e., 32° on either side of the plane of the flukes 21) and braces 51 sized and positioned to produce a maximum angular movement of 66° (i.e., 33° on either side of the flukes 21).

The anchor 11 is used in the customary manner.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lightweight anchor comprising:

a. a stock, b. a crown mounted on the stock, c. a shank mounted on the stock, and d. a pair of flukes mounted on the stock, one on each side of the shank, the flukes and shank being pivotally movable relative to each other, each fluke comprising two sheets of metal of the same size and shape, stacked one on top of the other, in alignment with one another and laminated together, each sheet of metal containing a plurality of integrally formed, raised, longitudinally extending, strengthening ribs, said ribs on each sheet being raised in an outward direction.

2. The anchor of claim 1 and wherein each sheet of each fluke includes an inner edge and an outer edge and wherein the inner and outer edge of each sheet are bent to form upwardly extending perpendicular flanges.

3. The anchor of claim 1 and where the ribs on each sheet are parallel.

4. The anchor of claim 3 and wherein the two sheets of each fluke are laminated together by welding.

5. The anchor of claim 4 and wherein the sheet material used for the flukes is stainless steel.

6. The anchor of claim 5 and wherein the surfaces of the flukes are electropolished.

7. The anchor of claim 6 and wherein the anchor further includes a pin and slot means for limiting angular movement of the shank relative to the flukes, said pin and slot means including a pin fixed to the shank.

8. The anchor of claim 6 and further including a pair of generally U-shaped braces connected to the flukes for preventing yawning of the flukes and also limiting angular movement of said flukes relative to the shank and wherein the crown is a generally U-shaped member made of a single sheet of stainless steel plate stock, the legs of the of the U-shaped member being substantially parallel and being directed away from the flukes.

9. The anchor of claim 1 and wherein the ribs on the two sheets of each fluke are aligned with each other.

10. The anchor of claim 9 and wherein the shank is stainless steel tubing, and pivotally mounted on the stock the flukes are welded to the stock, the crown is welded to the stock and the anchor further includes a pair of support plates, each plate being welded to the crown, the stock and one of the flukes, and each plate including an arcuate slot adapted to cooperate with the pin fixed to the shank for limiting the angular movement of the shank.

11. A fluke for use in a lightweight anchor comprising a pair of generally trapezoidal-shaped sheets of stainless steel stacked one on top of the other and welded together, each sheet having inner and outer parallel edges and top and bottom surfaces, each sheet containing a plurality of longitudinally extending, parallel, integrally formed, raised ribs, said ribs being generally semicircular in cross-section, the ribs on each sheet being raised in a direction away from said other sheet, the inner and outer edges of each sheet being turned in an upward direction away from said other sheet to form perpendicular flanges, the exposed surfaces of each sheet being electropolished.

* * * * *